US010968796B2

(12) United States Patent
Konishi et al.

(10) Patent No.: US 10,968,796 B2
(45) Date of Patent: Apr. 6, 2021

(54) BREATHER STRUCTURE OF ENGINE

(71) Applicant: Honda Motor Co., Ltd., Tokyo (JP)

(72) Inventors: Yukio Konishi, Saitama (JP); Hikaru Ueno, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/451,028

(22) Filed: Jun. 25, 2019

(65) Prior Publication Data

US 2020/0025048 A1 Jan. 23, 2020

(30) Foreign Application Priority Data

Jul. 23, 2018 (JP) ..... JP2018-137346
Aug. 10, 2018 (JP) ..... JP2018-151403

(51) Int. Cl.
*F01M 13/04* (2006.01)

(52) U.S. Cl.
CPC . *F01M 13/0416* (2013.01); *F01M 2013/0433* (2013.01); *F01M 2013/0461* (2013.01)

(58) Field of Classification Search
CPC ..... F01M 13/0416; F01M 2013/0433; F01M 2013/0461
See application file for complete search history.

(56) References Cited

U.S. PATENT DOCUMENTS 3,949,719 A 4/1976 Bellanca et al.
8,726,876 B2 * 5/2014 Kobayashi ..... F01M 13/0416 123/196 CP

FOREIGN PATENT DOCUMENTS

| | | |
|---|---|---|
| CN | 1573016 | 2/2005 |
| CN | 101109307 | 1/2008 |
| CN | 201148891 | 11/2008 |
| CN | 101684764 | 3/2010 |
| CN | 201650406 | 11/2010 |
| CN | 103133083 | 6/2013 |
| CN | 103174492 | 6/2013 |
| CN | 103732870 | 4/2014 |
| DE | 102009036443 | 2/2011 |
| DE | 102012111721 | 6/2014 |
| EP | 0154910 | 9/1985 |
| EP | 0287756 | 10/1988 |

(Continued)

OTHER PUBLICATIONS

Office Action of Japan Counterpart Application, with English translation thereof, dated Feb. 19, 2020, pp. 1-8.

(Continued)

*Primary Examiner* — Kevin A Lathers
(74) *Attorney, Agent, or Firm* — JCIPRNET

(57) ABSTRACT

The disclosure prevents oil separated from blow-by gas by using a breather chamber and discharged to a valve chamber from leaking to the outside from a breather chamber mounting surface between the breather chamber and the valve chamber. A breather chamber includes cylindrical drain passages communicating with a valve chamber, and tips of the drain passages exceed breather chamber mounting surfaces of a cylinder head and a head cover and protrude from opening parts toward a side of the valve chamber, so the oil separated from the blow-by gas in the breather chamber can be reliably discharged to the valve chamber and prevented from leaking to the outside from the breather chamber mounting surfaces.

7 Claims, 7 Drawing Sheets

(56) References Cited

FOREIGN PATENT DOCUMENTS

| | | |
|---|---|---|
| EP | 0454512 | 12/1992 |
| EP | 1275828 | 1/2003 |
| GB | 1183536 | 3/1970 |
| JP | S62076219 | 5/1987 |
| JP | S63173811 | 7/1988 |
| JP | H01114910 | 8/1989 |
| JP | H0821226 | 1/1996 |
| JP | 2504073 | 6/1996 |
| JP | 2002021526 | 1/2002 |
| JP | 2006226177 | 8/2006 |
| JP | 2007177685 | 7/2007 |
| JP | 4425951 | 3/2010 |
| JP | 4581829 | 11/2010 |
| JP | 2011157927 | 8/2011 |
| JP | 2015031195 | 2/2015 |
| JP | 2016098711 | 5/2016 |
| JP | 2016194276 | 11/2016 |
| JP | 2017219014 | 12/2017 |
| WO | 2013179829 | 12/2013 |

OTHER PUBLICATIONS

Office Action of China Counterpart Application, with English translation thereof, dated Feb. 2, 2021, pp. 1-14.

* cited by examiner

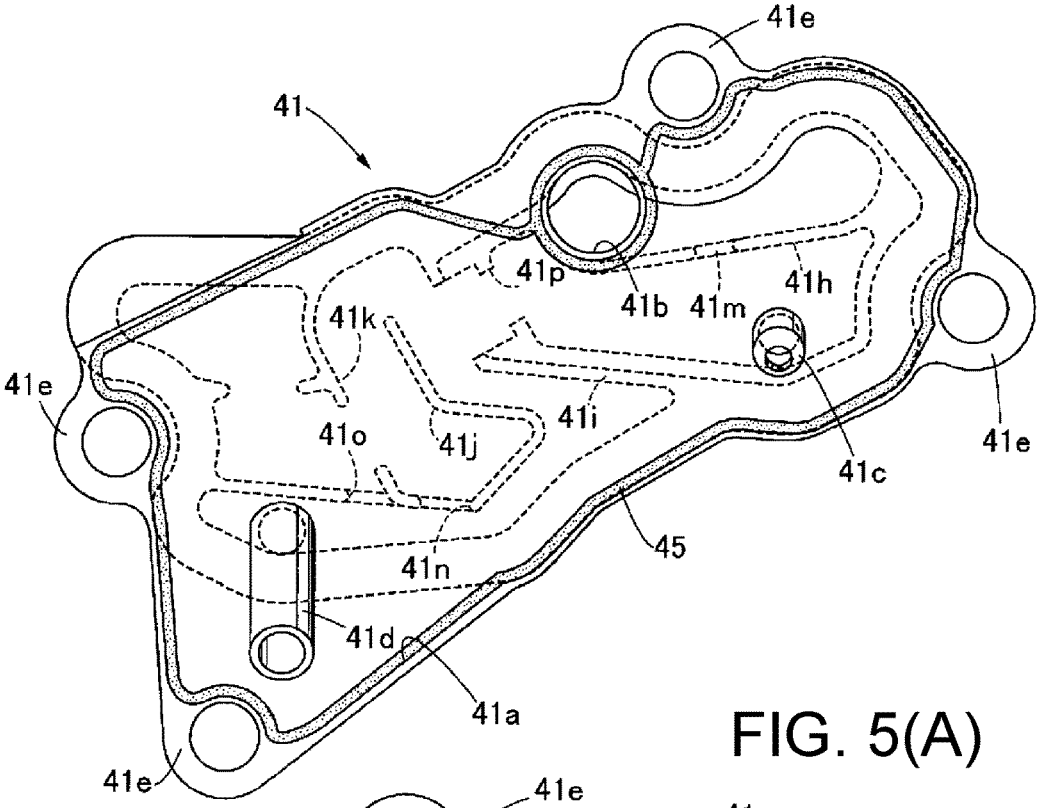
FIG. 5(A)
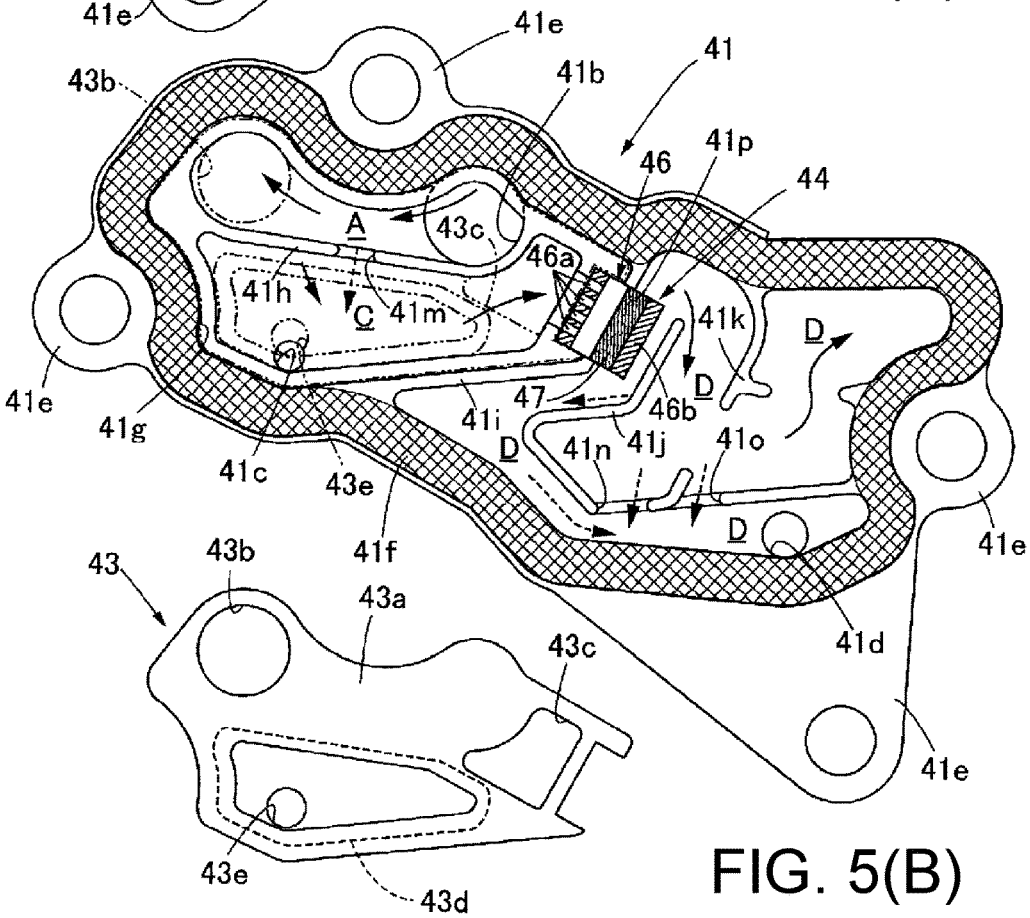
FIG. 5(B)
FIG. 5(C)

BREATHER STRUCTURE OF ENGINE

CROSS-REFERENCE TO RELATED APPLICATION

This application claims the priority benefit of Japan Application No. 2018-137346, filed on Jul. 23, 2018 and Japan Application No. 2018-151403, filed on Aug. 10, 2018. The entirety of the above-mentioned patent application is hereby incorporated by reference herein and made a part of this specification.

BACKGROUND

Technical Field

The disclosure relates to a breather structure of an engine, in which a valve chamber accommodating a camshaft is defined between a cylinder head shared by two banks of a V-type engine and a head cover mounted to the cylinder head, an opening part which a shaft end of the camshaft faces is formed on a breather chamber mounting surface crossing the cylinder head and the head cover, and the breather chamber communicating an intake passage upstream of a throttle valve with the valve chamber is mounted with the breather chamber mounting surface.

Description of Related Art

It is known according to Patent Document 1 (Japanese Patent No. 2504073) below that a shaft end of a camshaft accommodated in a valve chamber provided at a cylinder head is supported by a bearing, an oil separating space facing the shaft end of the camshaft is defined in the interior of a fitting bonded to an outer surface of the bearing, oil contained in blow-by gas supplied from the crankcase to the interior of the camshaft is separated by a centrifugal force and discharged from the oil separating space to the valve chamber, and oil-separated blow-by gas flows back from the oil separating space to an intake system of the engine.

Also, it is known according to Patent Document 2 (Japanese Patent No. 4581829) below that an oil separator stored in a valve chamber of an engine and separating oil from blow-by gas includes an oil separating mechanism formed of a throttle plate, a capturing plate, and a backflow preventing plate disposed on a blow-by gas passage connecting an inlet port and an outlet port of the blow-by gas.

Also, it is known according to Patent Document 3 (Japanese Patent No. 4425951) below that an oil separator which separates oil from blow-by gas includes a first oil separator and a second oil separator provided in the interior of a housing, and the first oil separator and the second oil separator perform oil separation respectively and independently.

However, in the case in which a breather chamber mounting surface is formed so as to cross two side surfaces of a head cover and a cylinder head of an engine, and oil separated from blow-by gas is discharged to a valve chamber formed in the interior of the cylinder head and the head cover by using a breather chamber mounted with the breather chamber mounting surface, the breather chamber mounting surface divided into two may tend to have a reduced sealing property, and it is possible that the oil discharged from the breather chamber may leak to the outside from the breather chamber mounting surface.

SUMMARY

According to an aspect of the disclosure, in a breather structure of an engine, a valve chamber accommodating a camshaft is defined between a cylinder head shared by two banks of a V-type engine and a head cover mounted to the cylinder head, an opening part which a shaft end of the camshaft faces is formed on a breather chamber mounting surface crossing the cylinder head and the head cover, and a breather chamber communicating an intake passage upstream of a throttle valve with the valve chamber is mounted to the breather chamber mounting surface. In addition, the breather chamber includes a cylindrical drain passage communicating with the valve chamber, and a tip of the drain passage exceeds the breather chamber mounting surface and protrudes from the opening part toward a side of the valve chamber.

BRIEF DESCRIPTION OF THE DRAWINGS

FIGS. 5(A), 5(B), and 5(C) are views taken in directions of arrows 5A, 5B and 5C of FIG. 4.

DESCRIPTION OF THE EMBODIMENTS

Figure 1:
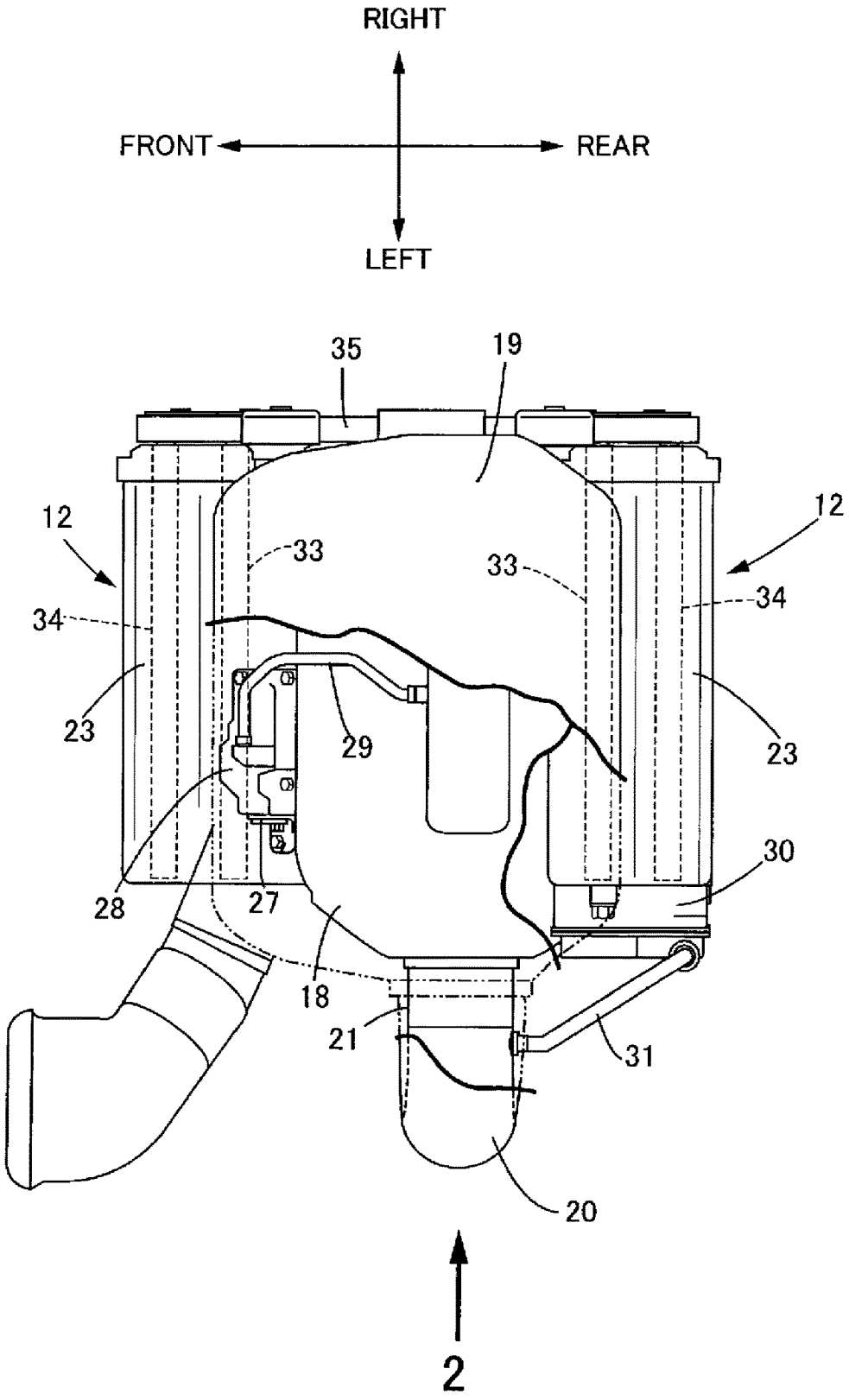
FIG. 1 is a top view of a V-type multi-cylinder engine.

The disclosure prevents the oil separated from the blow-by gas and discharged to the valve chamber by using the breather chamber from leaking to the outside from the breather chamber mounting surface between the breather chamber and the valve chamber.

According to an aspect of the disclosure, in a breather structure of an engine, a valve chamber accommodating a camshaft is defined between a cylinder head shared by two banks of a V-type engine and a head cover mounted to the cylinder head, an opening part which a shaft end of the camshaft faces is formed on a breather chamber mounting surface crossing the cylinder head and the head cover, and a breather chamber communicating an intake passage upstream of a throttle valve with the valve chamber is mounted to the breather chamber mounting surface. In addition, the breather chamber includes a cylindrical drain passage communicating with the valve chamber, and a tip of the drain passage exceeds the breather chamber mounting surface and protrudes from the opening part toward a side of the valve chamber.

According to an embodiment of the disclosure, in the breather structure of the engine, a first opening part and a second opening part facing shaft ends of an intake camshaft and an exhaust camshaft are formed on the breather chamber mounting surface, the breather chamber includes at least a first chamber and a second chamber defined by sandwiching an oil separating member separating oil from blow-by gas, a first drain passage of the first chamber protrudes from the first opening part toward the side of the valve chamber, and a second drain passage of the second chamber protrudes from the second opening part toward the side of the valve chamber.

According to an embodiment of the disclosure, in the breather structure of the engine, the oil separating member includes a plurality of orifices through which the blow-by gas passes and a collision wall with which the blow-by gas passing through the orifices collides.

According to an embodiment of the disclosure, in the breather structure of the engine, the oil separating member includes a filter disposed between the orifices and the collision wall.

According to an embodiment of the disclosure, in the breather structure of the engine, a volume of the second chamber communicating with the intake passage is greater than a volume of the first chamber communicating with the valve chamber.

According to an embodiment of the disclosure, in the breather structure of the engine, the breather chamber includes a case mounted to the breather chamber mounting surface, a cover bonded to the case, and a partition member sandwiched between the case and the cover.

The air flow tube 20 of the embodiment corresponds to the intake passage of the disclosure, and the intake camshaft 33 and the exhaust camshaft 34 of the embodiment correspond to the camshaft of the disclosure, the first opening part 36*a* and the second opening part 36*b* of the embodiment correspond to the opening part of the disclosure, the first drain passage 41*c* and the second drain passage 41*d* of the embodiment correspond to the drain passage of the disclosure, the first to third communication holes 43*b*, 43*c* and 43*d* of the embodiment correspond to the communication hole of the disclosure.

According to an embodiment of the disclosure, since the valve chamber accommodating the camshaft is defined between the cylinder head shared by the two banks of the V-type engine and the head cover mounted to the cylinder head, the opening part which the shaft end of the camshaft faces is formed on the breather chamber mounting surface crossing the cylinder head and the head cover, and the breather chamber communicating the intake passage upstream of the throttle valve with the valve chamber is mounted to the breather chamber mounting surface, when the blow-by gas in the valve chamber flows back to the intake passage side, by discharging the oil separated from the blow-by gas in the breather chamber to the valve chamber, oil can be prevented from being adhered to the throttle valve downstream of the intake passage.

According to an embodiment of the disclosure, since the first opening part and the second opening part facing the shaft ends of the intake camshaft and the exhaust camshaft are formed on the breather chamber mounting surface, the breather chamber includes at least the first chamber and the second chamber defined by sandwiching the oil separating member separating the oil from the blow-by gas, the first drain passage of the first chamber protrudes from the first opening part toward the valve chamber side, and the second drain passage of the second chamber protrudes from the second opening part toward the valve chamber side, by separating the oil contained in the blow-by gas in three stages, i.e., in the first chamber, the oil separating member and the second chamber, not only can the oil separation efficiency be improved, the oil retained in the first chamber and the second chamber can be reliably discharged to the valve chamber by the first drain passage and the second drain passage.

According to an embodiment of the disclosure, the oil separating member has the orifices through which the blow-by gas passes and the collision wall with which the blow-by gas passing through the orifices collides, the blow-by gas accelerated by the orifices can collide with the collision wall at a high speed to effectively separate the oil.

According to an embodiment of the disclosure, the oil separating member includes the filter disposed between the orifices and the collision wall, so that oil contained in the blow-by gas can be captured and separated more effectively.

According to an embodiment of the disclosure, since the volume of the second chamber communicating with the intake passage is greater than the volume of the first chamber communicating with the valve chamber, when the blow-by gas containing oil mist flows back from the valve chamber toward the intake passage side, not only the oil in the blow-by gas that cannot be completely removed by the oil separating member can be efficiently removed by reducing the flow rate of the blow-by gas by using the second chamber with a large volume, but the oil of the second chamber can also be prevented from being blown off toward an intake member side.

According to an embodiment of the disclosure, since the breather chamber includes the case mounted to the breather chamber mounting surface, the cover bonded to the case, and the partition member sandwiched between the case and the cover, the chambers having different volumes can be formed easily and compactly between the case and the cover.

Hereinafter, an embodiment of the disclosure will be described based on FIGS. 1 to 7.

Figure 2:
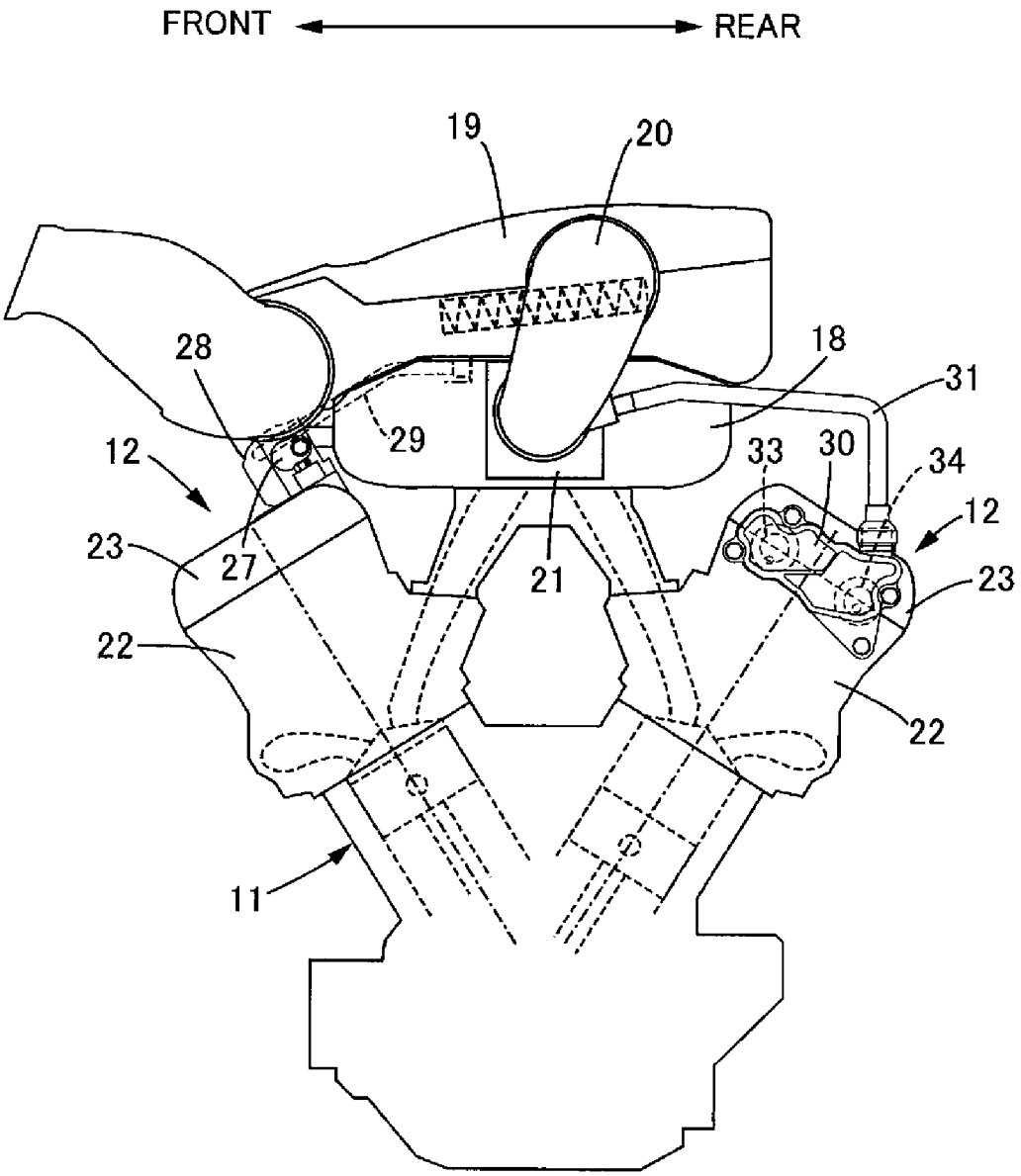
FIG. 2 is a view taken in a direction of an arrow 2 of FIG. 1.
Figure 3:
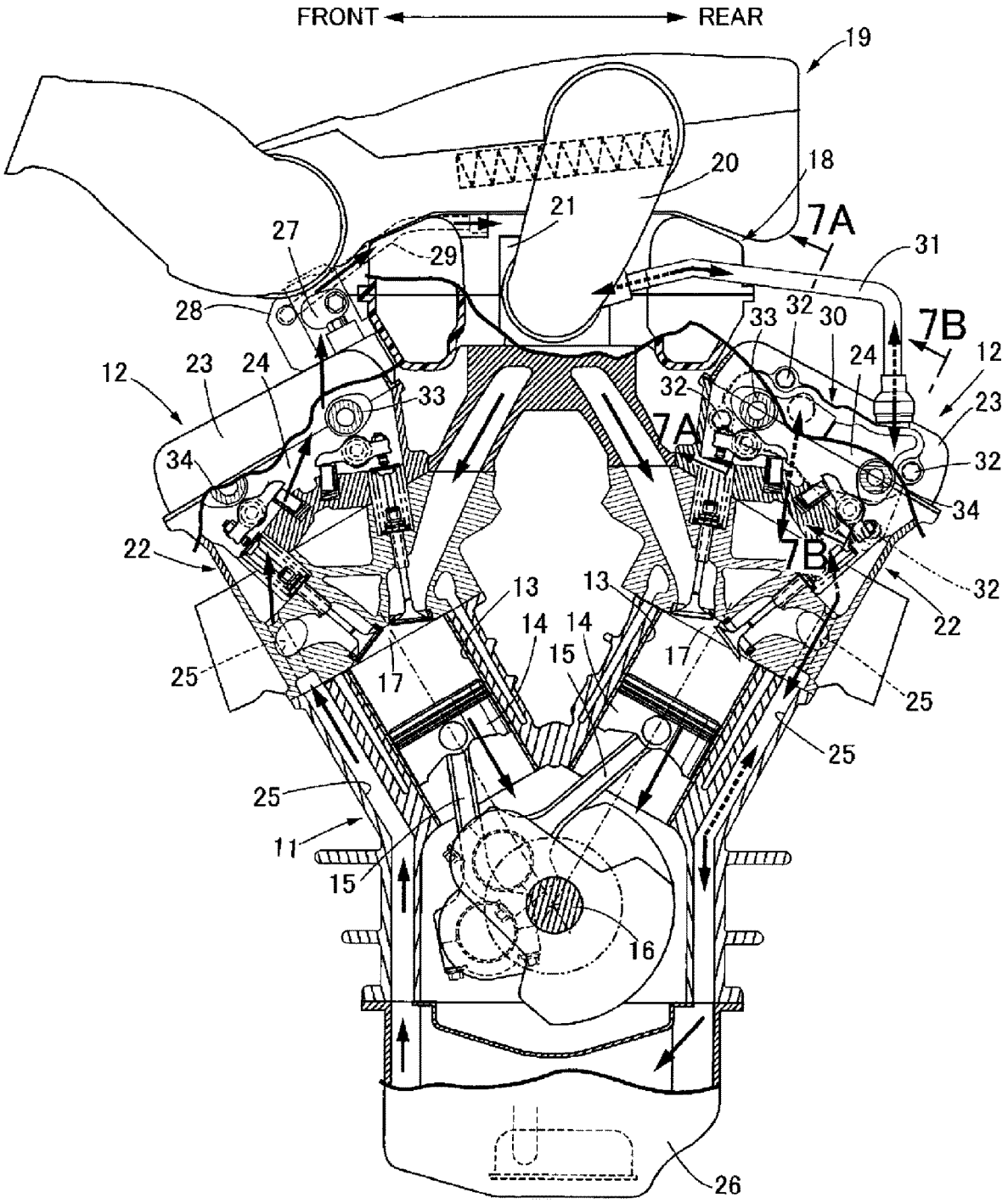
FIG. 3 is a cross-sectional view corresponding to FIG. 2.

As shown in FIGS. 1 to 3, a pair of banks 12 are formed at the front and the rear of the upper part of a cylinder block 11 of a V-type multi-cylinder engine, a piston 14 movably fitted to a cylinder 13 disposed in each bank 12 is connected to a crankshaft 16 via a connecting rod 15. An intake manifold 18 communicating with a combustion chamber 17 formed at the upper end of the cylinder 13 is disposed between the two banks 12, an air cleaner 19 disposed in the upper part of the intake manifold 18 is connected to a throttle valve 21 via an air flow tube 20 bent in a U-shape.

Each bank 12 includes a valve chamber 24 defined between a cylinder head 22 and a head cover 23, and the valve chamber 24 communicates with the interior of an oil pan 26 provided at the lower part of the cylinder block 11 via an oil return passage 25 penetrating through the cylinder head 22 and the interior of the cylinder block 11 of each bank 12.

A positive crankcase ventilation (PCV) chamber 28 having a PCV valve 27 is provided on the upper surface of the head cover 23 of the bank 12 on the front side, and the PCV chamber 28 is connected with the intake manifold 18 via a PCV pipe 29. In addition, a breather chamber 30 communicating with the valve chamber 24 is provided on an end surface on the left side of the bank 12 on the rear side, and the breather chamber 30 is connected with the air flow tube 20 upstream of the throttle valve 21 via a breather pipe 31.

As shown by the solid arrows in FIG. 3, as the engine operates, a portion of the mixed gas supplied to the combustion chamber 17 passes through a gap between the piston 14 and the cylinder 13, becomes blow-by gas including fuel vapor and mist-like oil, and stays in the crankcase. Since the intake negative pressure of the engine acts on the interior of the intake manifold 18 during operation of the engine, the PCV valve 27 formed of a check valve opens, the blow-by gas in the crankcase passes through the oil return passage 25 in the bank 12 on the front side, the PCV valve 27, the PCV chamber 28, the PCV pipe 29, and the intake manifold 18, is returned to the combustion chamber 17 of the bank 12 on the front side with intake air, and is combusted at the combustion chamber 17, so as to prevent the fuel vapor in the blow-by gas from being emitted to the atmosphere. At this time, oil is separated from the blow-by gas in the PCV chamber 28, and the separated oil is returned from the valve chamber 24 of the bank 12 on the front side into the oil pan 26 through the oil return passage 25 of the bank 12 on the front side.

If the blow-by gas in the crankcase continues to be suctioned to the intake manifold 18, the pressure in the crankcase becomes a negative pressure and the suctioning of the blow-by gas is hindered, so it is necessary to suppress the decrease in the internal pressure by replenishing fresh air into the crankcase. That is, as the internal pressure of the crankcase decreases, fresh air in the airflow tube 20 upstream of the throttle valve 21 at the atmospheric pressure passes through the breather pipe 31, the breather chamber 30, the valve chamber 24 of the bank 12 on the rear side, and the oil return passage 25 of the bank 12 on the rear side and is supplied into the crankcase.

Besides, if only fresh air in the air flow tube 20 is supplied into the crankcase, it is not necessary to provide the breather chamber 30 having the oil separating function on the path. The reason why the breather chamber 30 is required is set forth as follows.

Since the air flow tube 20 upstream of the throttle valve 21 is maintained at substantially the atmospheric pressure except for the case where the opening degree of the throttle valve 21 is a high opening degree equal to or greater than a predetermined value, the fresh air in the air flow tube 20 flows toward the crankcase side, but the intake negative pressure of the engine extends to the air flow tube 20 upstream of the throttle valve 21 if the opening degree of the throttle valve 21 becomes a high opening degree equal to or greater than a predetermined value; besides, the amount of blow-by gas generated increases and the internal pressure of the crankcase increases, so there is a case where the blow-by gas in the crankcase flows back to the side of the air flow tube 20, as indicated by broken arrows in FIG. 3. If the blow-by gas containing mist-like oil flows back to the side of the air flow tube 20 in this way, it is possible that the oil be adhered to the throttle valve 21 located downstream of the air flow tube 20 and cause contamination or malfunctioning. To prevent contamination or malfunctioning from happening, the breather chamber 30 having an oil separating function is provided on the backflow path of the blow-by gas, and oil contained in the blow-by gas is separated and returned to the oil pan 26.

Next, the structure of the breather chamber 30 and the periphery thereof will be described.

Figure 7A:
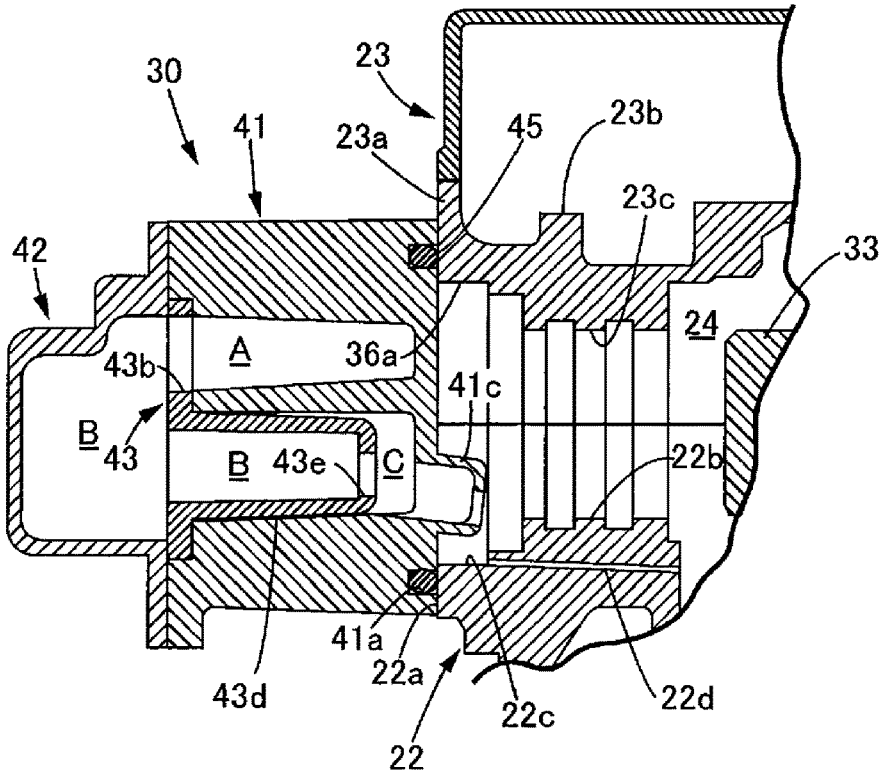
FIGS. 7(A) and 7(B) are sectional views taken along a line 7A-7A and a line 7B-7B of FIG. 3.
Figure 7B:
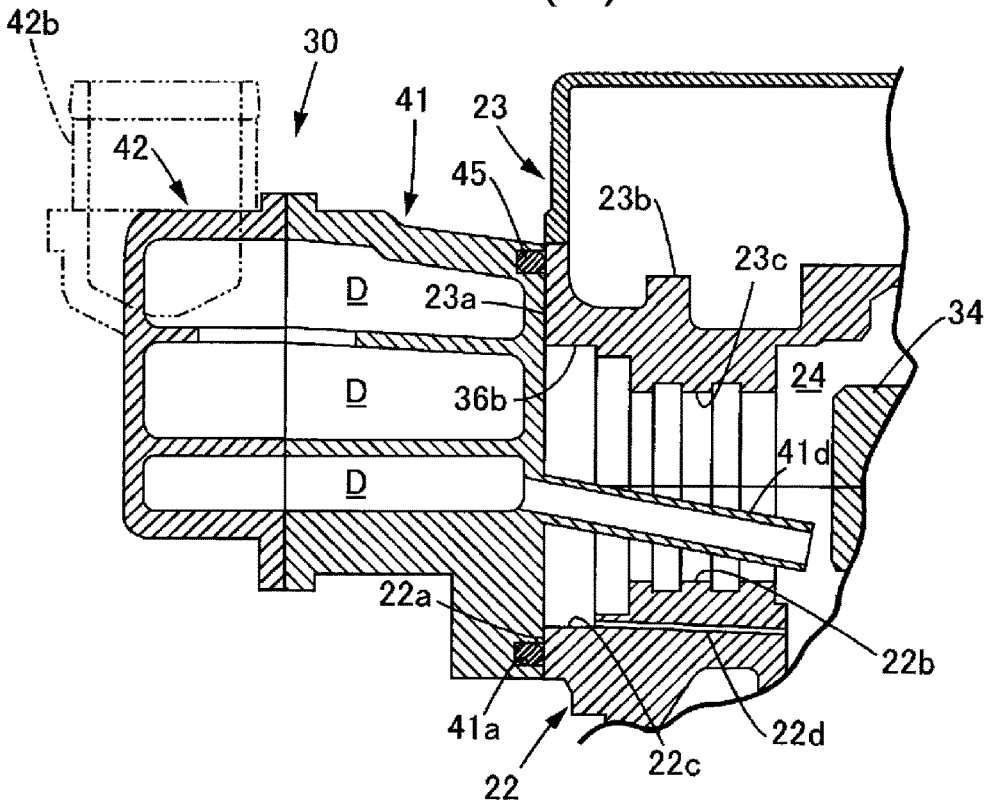

As shown in FIGS. 2 and 7(A) and 7(B), the breather chamber 30 is fixed by four bolts 32 to flat breather chamber mounting surfaces 22*a* and 23*a* formed on the end surface on the left side of the cylinder head 22 and the head cover 23 overlapped and fastened at the upper end of the bank 12 on the rear side of the cylinder block 11.

An intake camshaft 33 and an exhaust camshaft 34 are rotatably supported between a plurality of journal support parts 22*b* provided at the cylinder head 22 and a plurality of journal support parts 23*c* formed on a cam holder 23*b* provided on the side of the head cover 23, and the intake camshaft 33 and the exhaust camshaft 34 are connected with and driven by the crankshaft 16 by using a timing belt 35 (see FIG. 1) disposed on the right side surface of the engine.

Besides, in a normal V-type multi-cylinder engine, since a pair of cylinder heads respectively provided in the front and rear banks are constituted by different members whose shapes are mirror-symmetrical to each other, a sprocket is provided on the shaft end of the camshaft protruding from an opening part formed on an end side (the timing belt side) of the cylinder head, and the other end of the cylinder head (the side opposite to the timing belt) from which the shaft end of the camshaft does not protrude is closed in advance without an opening part.

However, in order to reduce the equipment cost of the mold for casting the cylinder head, with regard to the cylinder head 22 of this embodiment, the banks 12 at the front and the rear share the same shape. In this way, the cylinder head 22 of this embodiment shared by the left and right banks 12 is formed with opening parts on the two end sides, and the intake camshaft 33 and the exhaust camshaft 34 protrude from the opening parts.

By focusing on the bank 12 on the rear side to which the breather chamber 30 is attached, as apparent from FIGS. 7(A) and 7(B), a first opening part 36*a* and a second opening part 36*b*, which the intake camshaft 33 and the exhaust camshaft 34 can respectively penetrate, are formed on the breather chamber mounting surfaces 22*a* and 23*a* formed at the left end of the cylinder head 22 and the head cover 23, so that the journal support parts 22*b* and 23*c*, which can support the journals of the intake camshaft 33 and the exhaust camshaft 34, are formed to be adjacent to the first opening part 36*a* and the second opening part 36*b*.

However, at the end part on the left side of the cylinder head 22 of the bank 12 on the rear side to which the breather chamber 30 is attached, since the intake camshaft 33 and the exhaust camshaft 34 do not protrude to the outside, the first opening part 36*a* and the second opening part 36*b* and the journal support parts 22*b* and 23*c* are not used to support the intake camshaft 33 and the exhaust camshaft 34, and the first opening part 36*a* and the second opening part 36*b* are blocked by the breather chamber 30.

Since the first opening part 36*a* and the second opening part 36*b* as well as the journal support parts 22*b* and 23*c* at the left end of the cylinder head 22 and the head cover 23 of the bank 12 on the front side are not used to support the intake camshaft 33 and the exhaust camshaft 34, either, the first opening part 36*a* and the second opening part 36*b* are blocked by a member such as a cap.

As shown in FIGS. 4 to 7(B), the breather chamber 30 includes a synthetic resin case 41 fastened by the four bolts 32 to the breather chamber mounting surfaces 22*a* and 23*a* of the cylinder head 22 and the head cover 23, a synthetic resin cover 42 vibration-welded to the left end of the case 41, a synthetic resin partition member 43 sandwiched between case 41 and cover 42, and an oil separating member 44 separating oil from the blow-by gas flowing in the interior of the breather chamber 30. The vibration-welded split surfaces of the case 41 and the cover 42 are shown as hatched parts in FIGS. 5(A) to 5(C) and FIGS. 6(A) and 6(B).

The right side surface (see FIG. 5(A)) of the case 41 mounted to the breather chamber mounting surface 22*a* and 23*a* of the cylinder head 22 and the head cover 23 is substantially flat, and is formed with a seal groove 41*a* in which a seal member 45 sealing between the breather chamber mounting surfaces 22*a* and 23*a* is fit, an opening part 41*b* communicating with the interior of the valve chamber 24, a first drain passage 41*c* and a second drains passage 41*d* which are cylindrical and protrude toward the side of the cylinder head 22 and the head cover 23, and four base parts 41*e* through which the four bolts 32 screwed to the breather chamber mounting surfaces 22*a* and 23*a* penetrate.

Figure 4:
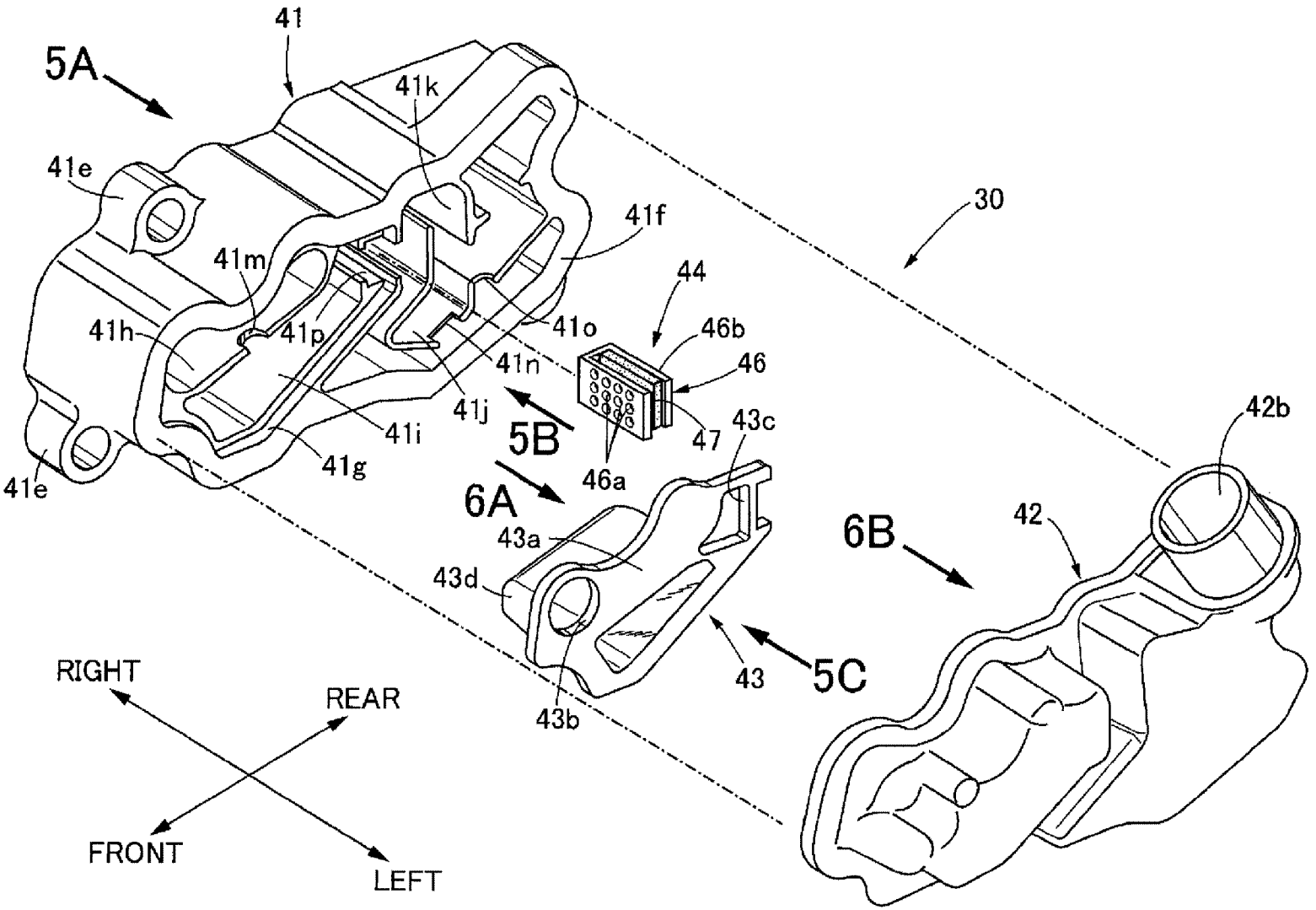
FIG. 4 is an exploded perspective view of a breather chamber.

On the left side surface (see FIGS. 4 and 5(B)) of the case 41 bonded to the cover 42, a concave space whose outer periphery is substantially surrounded by a peripheral wall 41*f* is formed, a shallow step 41*g* with which the partition member 43 is fitted and a plurality of barrier walls 41*h* to 41*k* constituting a labyrinth are provided on the inner side of the peripheral wall 41*f*, an oil hole 41*m* formed of a notch is formed on the barrier wall 41*h*, two oil holes 41*n* and 41*o* formed of notches are formed on the barrier wall 41*j*, and an oil separating member support groove 41*p* with which the oil separating member 44 is fit is formed between the barrier wall 41*f* and the barrier wall 41*i*.

Figure 6A:
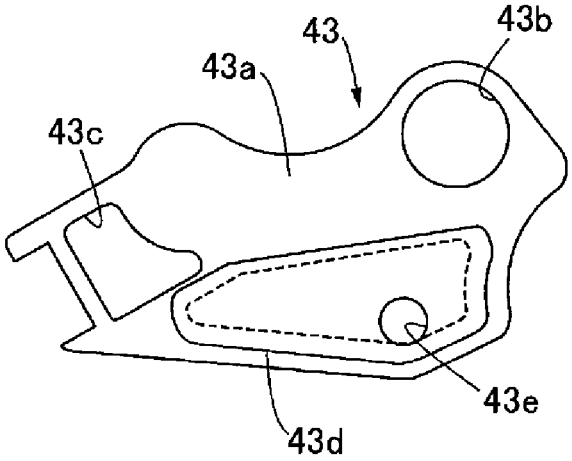
FIGS. 6(A) and 6(B) are views taken in directions of arrows 6A and 6B of FIG. 4.

The partition member 43 (see FIG. 4, FIG. 5(C) and FIG. 6(A)) engaged with the step 41*g* of the case 41 and held by the cover 42 has a flat barrier wall part 43*a*, a first communication hole 43*b* and a second communication hole 43*c* penetrating through the barrier wall part 43*a*, and a bulging part 43*d* bulging from the lower half of the barrier wall part 43*a* toward the side of the case 41 in a bag shape, and a third communication hole 43*e* opened at the bottom part of the bulging part 43*d*.

Figure 6B:
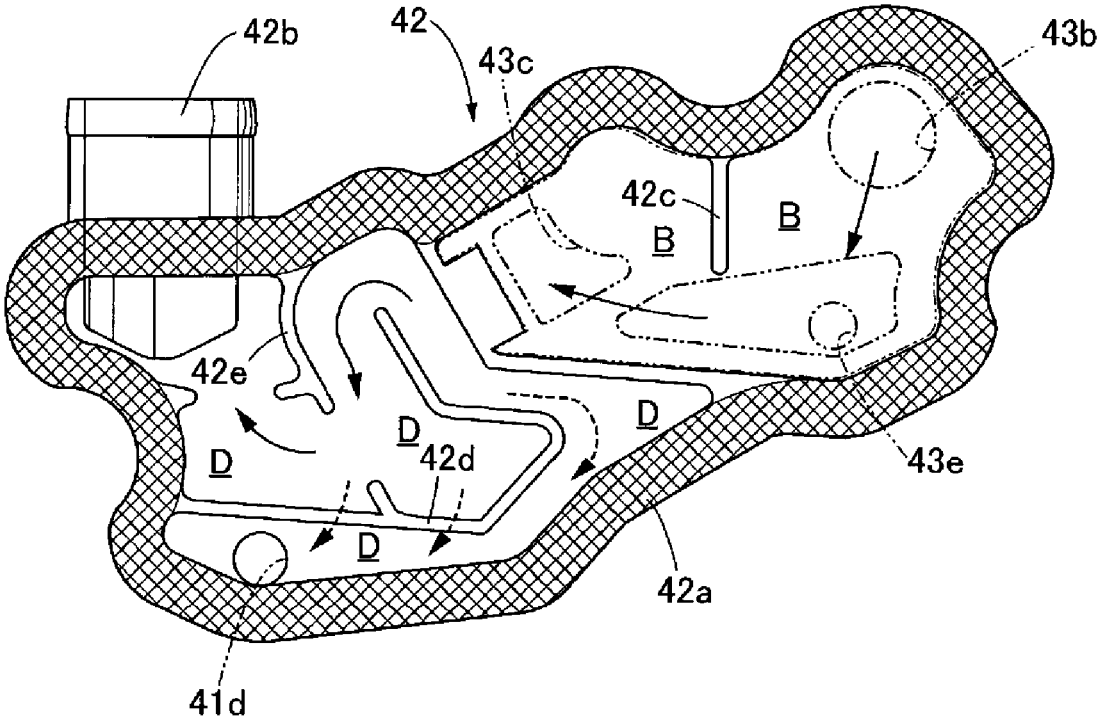

On the right side surface (see FIG. 6(B)) of the cover 42 bonded to the case 41, a concave space whose outer periphery is substantially surrounded by a peripheral wall 42*a* is formed, a joint part 42*b* with which the breather pipe 31 is connected protrudes upward on the peripheral wall 42*a*, and a plurality of barrier walls 42*c* to 42*e* constituting a labyrinth are formed on the inner side of the peripheral wall 42*a*.

The oil separating member 44 engaged with the oil separating member supporting groove 41*p* of the case 41 and held by the cover 42 includes a frame 46 bent in a U-shape, a plurality of orifices 46*a* are formed in one of the leg parts of the frame 46, and the other leg part constitutes a collision wall 46*b* opposing the orifices 46*a*. Then, a filter 47 manufactured with fleece as a soft brushed fiber material made of polyethylene terephthalate is fixed to the collision wall 46*b* so as to oppose the orifices 46*a*.

In the breather chamber 30 in which the case 41, the cover 42, the partition member 43, and the oil separating member 44 so configured are assembled, when blow-by gas flows back, namely when the blow-by gas of the valve chamber 24 flows in from the opening part 41*b* of the case 41 and flows out from the joint part 42*b* of the cover 42 toward the air flow tube 20, first chambers A, B and C are defined in the range from the opening part 41*b* to the oil separating member 44 as the upstream side thereof, and a second chamber D is defined in the range from the oil separating member 44 to the joint part 42*b* as the downstream side thereof.

As apparent from FIGS. 5 (B), 6 (B), 7(A) and 7(B), the chamber A and the chamber C are defined between the case 41 and the partition member 43, the chamber A on the upper side communicates with the valve chamber 24 via the opening part 41*b* of the case 41, and communicates with the chamber C that is lower through the communication hole 41*m* of the barrier wall part 41*h*. Then, the chamber C communicates with the valve chamber 24 via a first drain passage 41*c* of the case 41.

The chamber B is defined between the partition member 43 and the cover 42, communicates with the chamber A via the first communication hole 43*b* of the partition member 43, and communicates with the chamber C via the third communication hole 43*e* of the bulging part 43*d* of the partition member 43. In addition, the chamber B communicates with the oil separating member 44 via the second communication hole 43*c* of the partition member 43.

The second chamber D defined between the case 41 and the cover 42 and communicating with the chamber B via the oil separating member 44 is configured to be labyrinth-like with the barrier walls 41*j* and 41*k* of the case 41 and barrier walls 42*d* and 42*e* of the cover 42 abutting each other, and two oil holes 41*n* and 410 are formed on the barrier wall 41*j* of the case 41. The second chamber D communicates with the valve chamber 24 via a second drain passage 41*d* provided at the lower part of the case 41.

When the blow-by gas flows back, it is set that the volume of the second chamber D located downstream is greater than the volume of the first chambers A, B, and C located upstream of the oil separating member 44.

As apparent from FIGS. 7(A) and 7(B), the tip of the first drain passage 41*c* extending from the chamber C of the breather chamber 30 exceeds the breather chamber mounting surfaces 22*a* and 23*a* of the cylinder head 22 and the head cover 23 and extends from the first opening part 36*a* to the interior on the side of the valve chamber 24. Since the first drain passage 41*c* is relatively short, the tip of the first drain passage 41*c* is located closer to the side of the first opening part 36*a* than the unused journal support parts 22*b* and 23*c*.

Also, the tip of the second drain passage 41*d* extending from the second chamber D of the breather chamber 30 exceeds the breather chamber mounting surfaces 22*a* and 23*a* of the cylinder head 22 and the head cover 23 and extends into the interior of the valve chamber 24 by penetrating through the second opening part 36*b*. Since the second drain passage 41*d* is relatively long, the tip of the second drain passage 41*d* exceeds the unused journal support parts 22*b* and 23*c* and reaches the interior of the valve chamber 24. The tip of the second drain passage 41*d* is provided with a check valve (not shown) allowing the oil to pass through from the side of the breather chamber 30 to the side of the valve chamber 24.

A recess 22*c* in which oil can be retained is formed between the first opening part 36*a* and the second opening part 36*b* and the journal support parts 22*b* and 23*c* of the intake camshaft 33 and the exhaust camshaft 34. The recess 22*c* communicates with the interior of the valve chamber 24 via an oil discharge hole 22*d* penetrating through the lower parts of the journal support parts 22*b* and 23*c*.

Next, the operation of the breather chamber 30 including the above configuration will be described.

When the throttle valve 21 is at a high opening degree and the blow-by gas in the crankcase flows back to the side of the air flow tube 20, the blow-by gas of the valve chamber 24 flows into the chamber A from the opening part 41*b* of the case 41 of the breather chamber 30, collides with the barrier wall part 43*a* of the partition member 43 and turns a right angle, and flows into the chamber B from the first communication hole 43*b* of the partition member 43. At this time, the oil separated from the blow-by gas in the chamber A passes through the oil hole 41*m* of the barrier wall 41*h* constituting the bottom wall of the chamber A, and is discharged from the lower chamber C to the valve chamber 24 via the first drain passage 41*c* of the case 41.

The oil separated from the blow-by gas in the chamber B flows into the chamber C from the third communication hole 43*e* provided at the bottom part of the bulging part 43*d* of the partition member 43, and is discharged from the first drain passage 41*c* of the case 41 to the valve chamber 24 together with the separated oil in the chamber A.

The blow-by gas of the chamber B passes through the second communication hole 43*c* of the partition member 43 and is supplied to the oil separating member 44, and the blow-by gas passing through the orifices 46*a* of the oil separating member 44 and sped up collides with the collision wall 46*b*, thereby separating the oil. At this time, with the blow-by gas passing through the filter 47 disposed between the orifices 46*a* and the collision wall 46*b*, the filter 47 captures oil and facilitates separation. The oil separated by the oil separating member 44 is discharged from the bottom part of the second chamber D to the valve chamber 24 via the second drain passage 41*d* provided in the case 41.

The blow-by gas flowing from the oil separating member 44 into the second chamber D flows through the labyrinth-like passage until reaching the joint 42*b* of the cover 42 as the outlet thereof. Meanwhile, the oil separated from the blow-by gas passes through the oil holes 41*n* and 410 of the barrier wall 41*j*, falls downward, and is discharged to the valve chamber 24 via the second drain passage 41*d*.

The labyrinth flow path formed in the first chambers A, B, and C are composed of the chambers A, B, and C, the first communication hole 43*b*, the second communication hole 42*c*, and the third communication hole 43*e*. Since the variation amount of the flow path cross-sectional area of the labyrinth flow path formed in the first chambers A, B, and C is large, the flow rate of the blow-by gas can be increased or decreased to efficiently separate the oil by inertia force. On the other hand, since the variation amount of the flow path cross-sectional area of the labyrinth flow path formed in the second chamber D is small, the change of the flow rate of the blow-by gas in the second chamber D can be suppressed to thereby make the oil drop due to gravity and facilitate separation, and the oil can be prevented from being blown off with the blow-by gas and infiltrating the side of the air flow tube 20.

Also, since it is set that the volume of the second chamber D is greater than the volume of the first chambers A, B, and C, the separation of the oil due to gravity is facilitated in the second chamber D by rapidly reducing the flow rate of the blow-by gas passing through the oil separating member 44 and flowing into the second chamber D, and by reducing the flow rate of the blow-by gas in the second chamber D, it becomes difficult for the oil to infiltrate the side of the air flow tube 20.

When separating the oil from the blow-by gas by using the breather chamber, merely separating the oil by collision of the blow-by gas with the collision wall or separating the oil by a swirling motion of the blow-by gas is insufficient, and it is necessary to combine oil separating members in multiple stages to ensure reliable oil separation. In this embodiment, since the oil is separated in three stages by using the first chambers A, B and C, the oil separating member 44 and the second chamber D of the breather chamber 30, the oil can be separated reliably. Accordingly, the blow-by gas containing oil can be prevented from being supplied to the side of the air flow tube 20, and the oil can be prevented from being adhered to the throttle valve 21 located downstream of the air flow tube 20 and causing contamination or malfunction.

Besides, since the breather chamber 30 is configured by bonding the case 41 having the barrier walls 41*h* to 41*k*, the cover 42 having the barrier walls 42*c* to 42*e*, and the partition member 43 having the first communication hole 43*b*, the second communication hole 43*c* and the third communication hole 43*e*, the breather chamber 30 having the plurality of chambers of different volumes can be easily and compactly formed.

Moreover, assuming that the case 41 of the breather chamber 30 does not include the first drain passage 41*c* and the second drain passage 41*d* that are cylindrical, and a simple drain hole is opened on the first opening part 36*a* and the second opening part 36*b* of the breather chamber mounting surfaces 22*a* and 23*a* of the cylinder head 22 and the head cover 23, it is possible that the oil flowing out of the drain hole may leak to the outside from the mating surface between the breather chamber mounting surfaces 22*a* and 23*a* of the cylinder head 22 and the head cover 23 and the case 41 of the breather chamber 30.

However, according to this embodiment, since the tips of the first drain passage 41*c* and the second drain passage 41*d* provided in the case 41 of the breather chamber 30 exceed the breather chamber mounting surfaces 22*a* and 23*a* of the cylinder head 22 and the head cover 23 and protrude toward the side of the valve chamber 24, the oil separated from the blow-by gas in the breather chamber 30 can be reliably discharged to the valve chamber 24 to prevent the oil from leaking to the outside from the breather chamber mounting surfaces 22*a* and 23*a*.

The oil from the tips of the first drain passage 41*c* and the second drain passage 41*d*, particularly the oil from the relatively short first drain passage 41*c* tends to accumulate in the recess 22*c* on the proximal side of the journal support part 22*b* and flows to the breather chamber mounting surfaces 22*a* and 23*a*, but since the oil accumulated in the recess 22*c* is discharged to the interior of the valve chamber 24 via the oil discharge hole 22*d* (see FIGS. 7(A) and 7(B)) penetrating the lower side of the journal support parts 22*b* and 23*c*, the oil leakage from the breather chamber mounting surfaces 22*a* and 23*a* can be more reliably prevented.

Although the embodiment of the disclosure has been described above, the disclosure can be subjected to various design changes without departing from the scope of the disclosure.

For example, although the breather chamber 30 includes the first drain passage 41*c* and the second drain passage 41*d* in the embodiment, the number of drain passages is arbitrary.

Also, in the embodiment, while both the case 41 and the cover 42 of the breather chamber 30 have the barrier walls 41*h* to 41*k* and 42*c* to 42*e*, it may also be that at least one of the case 41 and the cover 42 includes the barrier walls.

What is claimed is:

1. A breather structure of an engine, wherein a valve chamber accommodating a camshaft is defined between a cylinder head shared by two banks of a V-type engine and a head cover mounted to the cylinder head, an opening part which a shaft end of the camshaft faces is formed on a breather chamber mounting surface crossing the cylinder head and the head cover, and a breather chamber communicating an intake passage upstream of a throttle valve with the valve chamber is mounted to the breather chamber mounting surface, and wherein the breather chamber comprises a cylindrical drain passage communicating with the valve chamber, and a tip of the drain passage exceeds the breather chamber mounting surface and protrudes from the opening part toward a side of the valve chamber, wherein a first opening part and a second opening part facing shaft ends of an intake camshaft and an exhaust camshaft are formed on the breather chamber mounting surface, the breather chamber comprises at least a first chamber and a second chamber defined by sandwiching an oil separating member separating oil from blow-by gas, a first drain passage of the first chamber protrudes from the first opening part toward the side of the valve chamber, and a second drain passage of the second chamber protrudes from the second opening part toward the side of the valve chamber.

2. The breather structure of the engine according to claim 1, wherein the oil separating member comprises a plurality of orifices through which the blow-by gas passes and a collision wall with which the blow-by gas passing through the orifices collides.

3. The breather structure of the engine according to claim 2, wherein the oil separating member comprises a filter disposed between the orifices and the collision wall.

4. The breather structure of the engine according to claim 1, wherein a volume of the second chamber communicating with the intake passage is greater than a volume of the first chamber communicating with the valve chamber.

5. The breather structure of the engine according to claim 4, wherein the breather chamber comprises a case mounted to the breather chamber mounting surface, a cover bonded to the case, and a partition member sandwiched between the case and the cover.

6. The breather structure of the engine according to claim 4, wherein a variation amount of a flow path cross-sectional area of a labyrinth flow path formed in the first chamber is greater than a variation amount of a flow path cross-sectional area of a labyrinth flow path formed in the second chamber.

7. The breather structure of the engine according to claim 6, wherein the first chamber is defined by sandwiching a partition member having a communication hole between the case and the cover, a flow path cross-sectional area of the chamber formed between the partition member and the cover is larger than a flow path cross-sectional area of the chamber formed between the case and the partition member.

* * * * *